US008038145B2

(12) United States Patent
Hirabayashi et al.

(10) Patent No.: US 8,038,145 B2
(45) Date of Patent: Oct. 18, 2011

(54) PRINTER

(75) Inventors: Kenichi Hirabayashi, Shiojiri (JP); Shinsuke Tomomatsu, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 39 days.

(21) Appl. No.: 12/378,361

(22) Filed: Feb. 12, 2009

(65) Prior Publication Data

US 2009/0200731 A1 Aug. 13, 2009

(30) Foreign Application Priority Data

Feb. 12, 2008 (JP) ..... 2008-030046

(51) Int. Cl.
*B65H 31/00* (2006.01)
*B65H 31/04* (2006.01)

(52) U.S. Cl. ..... 271/207; 271/213

(58) Field of Classification Search ..... 271/207, 271/213; 83/167
See application file for complete search history.

(56) References Cited

U.S. PATENT DOCUMENTS

| | | | | |
|---|---|---|---|---|
| 5,234,212 | A * | 8/1993 | Dutra, Jr. | 271/207 |
| 5,241,353 | A * | 8/1993 | Maeshima et al. | 399/405 |
| 5,464,205 | A * | 11/1995 | Bang | 271/213 |
| 6,582,139 | B2 * | 6/2003 | Abe et al. | 400/599.1 |
| 6,595,514 | B2 * | 7/2003 | Takahashi | 271/162 |
| 6,848,685 | B2 * | 2/2005 | Katsuyama | 271/162 |
| 7,073,787 | B2 * | 7/2006 | Kinsley et al. | 271/162 |
| 7,306,217 | B2 * | 12/2007 | Bandou et al. | 271/145 |
| 7,384,038 | B2 * | 6/2008 | Murai | 271/207 |
| 2008/0122164 | A1 * | 5/2008 | Sparer et al. | 271/207 |

FOREIGN PATENT DOCUMENTS

| | | |
|---|---|---|
| JP | 10-250894 | 9/1998 |
| JP | 2001-213552 | 8/2001 |

* cited by examiner

*Primary Examiner* — David H Bollinger
(74) *Attorney, Agent, or Firm* — Nutter McClennen & Fish LLP; John J. Penny, V.

(57) ABSTRACT

A printer comprising a cover, and a stacker that is attached to the cover, the stacker being supported pivotably about a pivot axis on the cover between a protruding position where the stacker receives paper discharged from the printer, and a retracted position rotated a predetermined angle from the protruding position.

12 Claims, 4 Drawing Sheets

PRINTER

This application claims priority under 35 U.S.C. §119 to Japanese Patent Application No. 2008-30046 filed on Feb. 12, 2008, the entire disclosure of which is expressly incorporated by reference herein.

BACKGROUND OF THE INVENTION

1. Field of Invention

The present invention relates to a printer that has an operable cover that, for example, opens and closes to access a storage compartment for storing printing paper, and relates more particularly to a printer having disposed on this cover a stacker for accumulating printing paper discharged from inside the printer.

2. Description of Related Art

With printers that print to continuous paper such as roll paper, a cover (a "roll paper cover" below) on the printer body that opens and closes is set to the position where the roll paper storage compartment is open so that the roll paper can be easily loaded or replaced. Japanese Unexamined Patent Appl. Pub. JP-A-2001-213552 teaches a printer that has an opening at the front of the printer body and a roll paper cover that closes this opening, and enables loading or replacing roll paper by lowering the roll paper cover forward to open the roll paper storage compartment to the outside.

The printer taught in JP-A-2001-213552 has a paper discharge table at the top end side of the roll paper cover. Support members for the discharge table extend inside the printer body from the paper exit above the roll paper cover, and are disposed to rotate freely on a support shaft that extends widthwise between the sides of the printer from the end sides of the platen inside the printer body. Because the roll paper cover is linked to the platen by a bracket, if the paper discharge table is pulled forward, the platen moves forward and up, and the roll paper cover located in front of the platen swings down.

In the printer taught in JP-A-2001-213552, the paper exit and a discharge table onto which the printed paper is discharged are positioned above the roll paper cover. However, because the support member for the discharge table extends from the platen side, and a protective plate, for example, that engages the top end part of the roll paper cover is disposed on the bottom of the discharge table, the construction of the discharge table and the support structure is complicated.

Printers that have a discharge tray or stacker attached directly to the front of the roll paper cover in order to catch paper that drops from the paper exit above the roll paper cover are also known. When the roll paper cover is opened forward on a printer of this construction, however, the discharge tray or stacker contacts and catches the surface between the roll paper cover and the printer (the surface extending from the surface on which the bottom of the printer rests to the front of the printer), thus preventing the roll paper cover from opening completely. As a result, the discharge tray or stacker must be removed every time the roll paper cover is opened, thus complicating replacing or loading the roll paper.

Printers that have a window formed in the roll paper cover for checking how much roll paper is left are also known, but if the discharge tray or stacker is installed to the front of the roll paper cover, this window becomes blocked and how much paper is left therefore cannot be confirmed.

SUMMARY OF THE INVENTION

A printer according to the present invention enables moving a stacker that is installed on the front of an opening and closing cover such as a roll paper cover so that the stacker does not interfere with opening and closing the cover, replacing the roll paper, or confirming how much paper remains.

A first aspect of at least one embodiment of the invention is a printer including an opening and closing cover, and a stacker that is attached to the open and close cover. The stacker is supported pivotably on the cover between a protruding position where the stacker receives paper discharged from the printer, and a retracted position rotated a predetermined angle from the protruding position.

In a printer according to this embodiment of the invention, one end of the stacker is attached pivotably to an opening and closing cover that pivots between an upright position and an inclined position, and the stacker can pivot between a protruding position where paper discharged from the printer can be received by the stacker, and a retracted position to which the stacker pivots away from the opening and closing cover. The stacker can therefore be moved from the front surface of the cover without removing the stacker by simply pivoting the stacker up. In addition, because the stacker can be retracted from between the bottom end side of the cover and the mounting surface of the printer without removing the stacker when the opening and closing cover is tilted to the open position, the stacker is prevented from interfering with opening the cover by simply moving the stacker to the retracted position. The opening to the printer can therefore be opened to a size enabling loading the roll paper. The trouble of removing the stacker in order to open the opening sufficiently wide can also be eliminated.

Preferably, the opening and closing cover is supported at a bottom part of the printer and can pivot between an upright closed position and an open position where the cover is tilted a predetermined angle, and when the stacker descends in conjunction with the opening and closing cover pivoting toward the open position, and the leading end in the descending direction of the stacker reaches a height substantially equal to a plane extending the bottom surface of the printer, a line from the pivot axis to the leading end of the stacker forms a predetermined angle to the extension plane.

Alternatively, when the stacker descends in conjunction with the opening and closing cover pivoting toward the open position, a line from the pivot axis to the leading end of the stacker slopes in the opposite direction as the slope from the pivot axis of the stacker to the pivot axis of the opening and closing cover relative to a line perpendicular passing through the pivot axis of the stacker.

The opening and closing cover is supported at the bottom end part of the printer, and one end of the stacker is pivotably attached to the opening and closing cover, which pivots between an upright position and a tilted position. The stacker can pivot on the opening and closing cover. When the stacker descends in conjunction with the cover rotating to the open position side, a part at the leading end in the direction in which the stacker descends is the first part of the stacker to contact the mounting surface of the printer (the surface on which the printer is placed, the extension plane of the bottom of the printer), and the point of contact between the mounting surface and the stacker is at a position farther from the bottom end of the cover than the point directly below the pivot point of the stacker. The force of repulsion from the mounting surface side to the stacker works to cause this leading distal end of the stacker to slide in the direction moving away from the bottom end of the opening and closing cover while also causing the stacker to pivot towards the top end side of the cover. The stacker can thus be removed from between the bottom end of the opening and closing cover and the mounting surface without removing the stacker, and the stacker can be moved so that it does not interfere with opening the cover. The opening providing access into the printer can thus be opened wide and the trouble of removing the stacker can be eliminated.

In a printer according to another aspect of at least one embodiment of the invention, the stacker has an arm part supported pivotably on the opening and closing cover, and when the opening and closing cover pivots toward the closed position, the arm part pivots toward the opening and closing cover, and the stacker moves to the protruding position.

By thus pivotably attaching the top end of the arm part to the opening and closing cover, the stacker is held by its own weight in the position protruding to the outside of the printer from the front of the cover when the opening and closing cover is closed. The arm part also pivots when the stacker is lifted, and the stacker can be pivoted to the retraction position side.

Further preferably, the length from the pivot axis of the stacker to the arm part side is greater than the distance from the pivot axis of the stacker to the front surface of the opening and closing cover.

When the cover is opened and the stacker is pivoted to the retracted position side, this aspect of the invention enables the stacker to move sufficiently away from the cover so that the stacker can continue to rotate smoothly and the cover does not interfere with the stacker after the stacker contacts the mounting surface of the printer. Therefore, when the cover is tilted to the open position side, problems such as the free end of the stacker (the opposite end as the pivot axis) not being able to separate sufficiently from the opening and closing cover, the stacker contacting the mounting surface of the printer and not being able to pivot further, the stacker pivoting in the opposite direction from which it should, and the stacker coming between the cover and the surface on which the printer is mounted, can be prevented.

Further preferably, the printer has a paper exit, the opening and closing cover has a discharge guide for guiding printing paper discharged from the paper exit, the discharge guide projects to the outside from the opening and closing cover, and the stacker is supported pivotably at a bottom end part of the discharge guide.

This aspect of the invention enables the stacker to receive paper dropping from the discharge guide because the stacker is held projecting to the outside of the printer from the front surface of the opening and closing cover at a position below the discharge guide.

A printer according to another aspect of the invention preferably has a damper mechanism that adjusts the speed of the opening and closing cover when the cover moves to the open position side. This damper mechanism can reduce the force of impact when the stacker contacts the mounting surface of the printer.

Yet further preferably, the printer has a window formed at a position in the opening and closing cover that is covered by the stacker when the cover is in the closed position.

This aspect of the invention enables rotating the stacker to the retracted position where it does not obstruct the window so that that the remaining amount of roll paper or other printing medium in the printer can be confirmed through the window. How much roll paper is left can thus be confirmed without removing the stacker.

In a printer according to another aspect of at least one embodiment of the invention, the opening and closing cover is attached to the front of the printer, and opens and closes an opening communicating with the printing paper storage compartment in the printer. This aspect of the invention enables application in a front-opening printer that has an opening and closing cover for loading and replacing printing paper at the front of the printer.

In a printer according to another aspect of at least one embodiment of the invention, the opening and closing cover is supported at a bottom part of the printer and can pivot between an upright closed position and an open position where the cover is tilted a predetermined angle. When the opening and closing cover is open, the opening is large enough to enable the storing of a roll of printing paper wound into a roll into the storage compartment.

A printer according to at least one embodiment of the present invention attaches one end of the stacker pivotably on a horizontal pivot axis to an opening and closing cover that can pivot open and closed. The stacker can pivot between a protruding position where paper discharged from the printer can be received by the stacker, and a retracted position to which the stacker pivots away from the opening and closing cover. Because the stacker can be retracted upward from the bottom end side of the opening and closing cover without removing the stacker from the cover when the cover moves to the open position side, the cover can be opened from the printer enough that the roll paper can be easily replaced. The stacker is also prevented from interfering with the opening of the cover. It is also not necessary to remove the stacker in order to open the opening to the printer wider. The stacker can also be moved out of the way from the front of the cover without removing the stacker.

Other objects and attainments together with a fuller understanding of the invention will become apparent and appreciated by referring to the following description and claims taken in conjunction with the accompanying drawings.

DESCRIPTION OF PREFERRED EMBODIMENTS

A preferred embodiment of at least one embodiment of the present invention is described below with reference to the accompanying figures.

General Configuration

Figure 1:
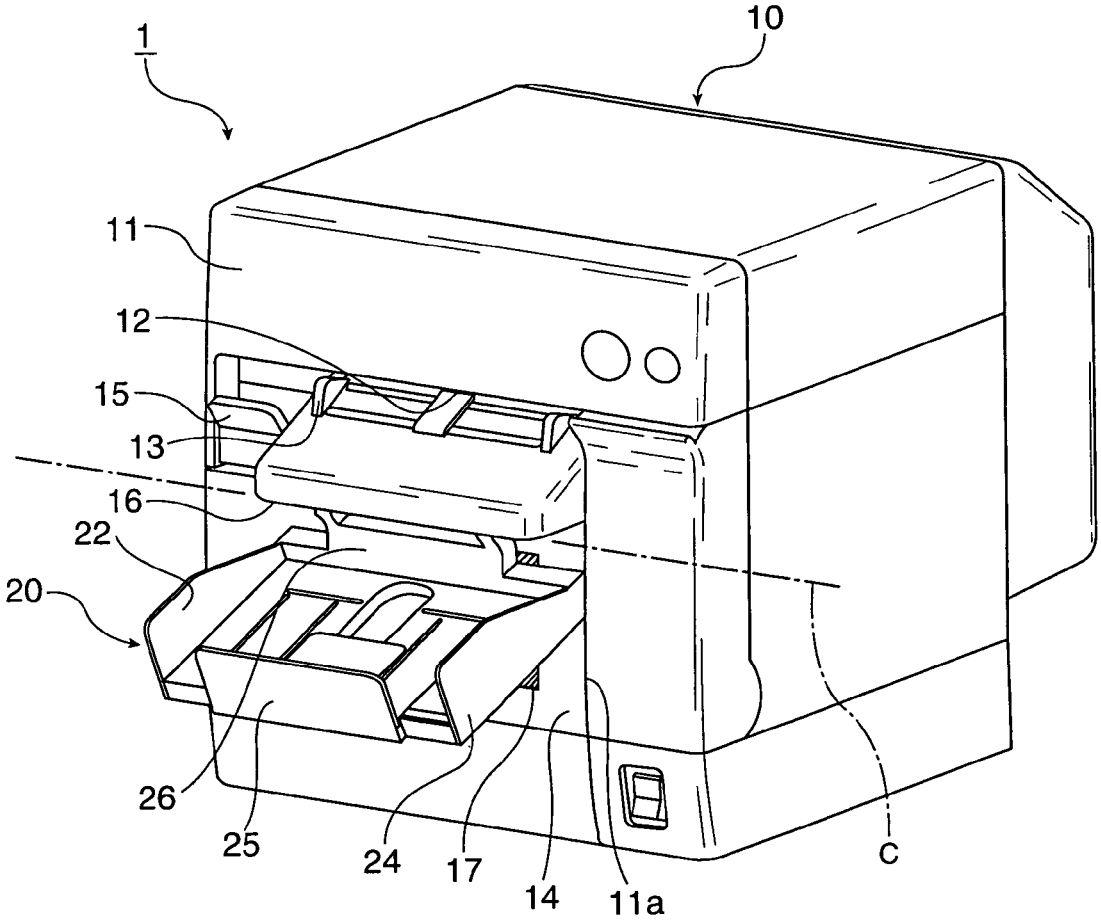
FIG. 1 is an oblique view of a roll paper printer according to a preferred embodiment of the invention.

FIG. 1 is an oblique view of a roll paper printer 1 according to a preferred embodiment of the invention. This roll paper printer 1 holds continuous paper such as roll paper (see FIG. 2B) inside the printer so that the paper can rotate freely, the printed portion can be cut from the roll with a paper cutter, and the cut printed portion can be discharged. As shown in FIG. 1, the roll paper printer 1 has a rectangular box-like printer body 10 and a stacker 20 attached to the front part of the outside case 11 of the printer body 10. A horizontal paper exit 12 that is wider than the width of the roll paper is disposed in the outside case 11 above the stacker 20, and a discharge guide 13 is disposed next to the paper exit 12.

The paper that is pulled off the roll paper 2, which is stored in a roll paper compartment inside the printer body 10, is pulled from the roll with a specific amount of tension applied to the paper by a pair of paper transportation rollers. The paper is conveyed intermittently at a predetermined pitch through a paper transportation path that passes the printing position inside the printer body 10 while a print head prints to the paper. After printing, the paper is cut by a cutting mechanism located in the inside of the paper exit 12, and the cut paper is then discharged from the paper exit 12 to the front of the printer body 10.

A rectangular opening 11*a* for replacing the roll paper 2 is formed below the paper exit 12 at the front of the outside case 11. This opening 11*a* is opened and closed by the roll paper cover 14 (an opening and closing cover).

An overhanging part 16 is disposed projecting on the front of the printer body 10 at the top end of the roll paper cover 14. The top surface of this overhanging part 16 is an inclined surface that slopes down, and a discharge guide 13 is mounted at the top end part of this slope. The overhanging part 16 and the discharge guide 13 thus work in unison to guide paper discharged from the paper exit 12 in a predetermined discharge direction. After printing by the print head is completed, the paper is cut by the paper cutter, and the portion of the paper discharged from the paper exit 12 slides along the top of the overhanging part 16 and drops from the distal end of the overhanging part 16 from above onto the stacker 20 on which the paper then accumulates.

One end of the stacker 20 is pivotably attached to the bottom side of the overhanging part 16. A lever 15 for opening and closing the roll paper cover 14 is disposed beside the discharge guide 13 and overhanging part 16 at a side part of the outside case 11. A window 17 made from transparent plastic, for example, is disposed below the overhanging part 16 so that the inside of the roll paper compartment in the printer body 10 can be seen.

Figure 2A:
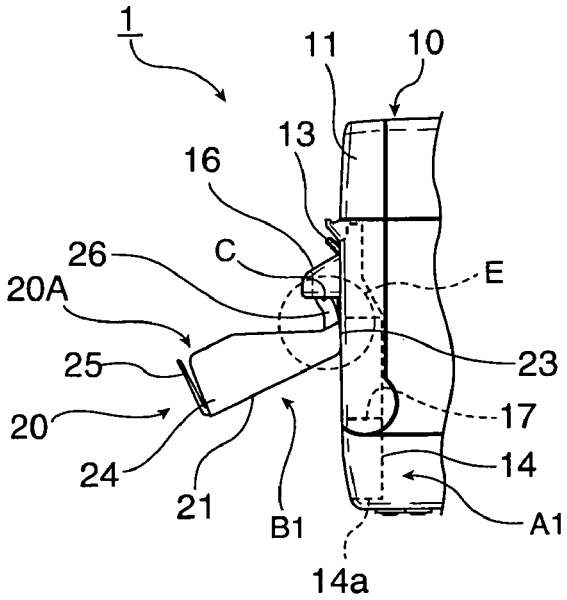
FIG. 2A is a section view when the roll paper cover is closed.
Figure 2B:
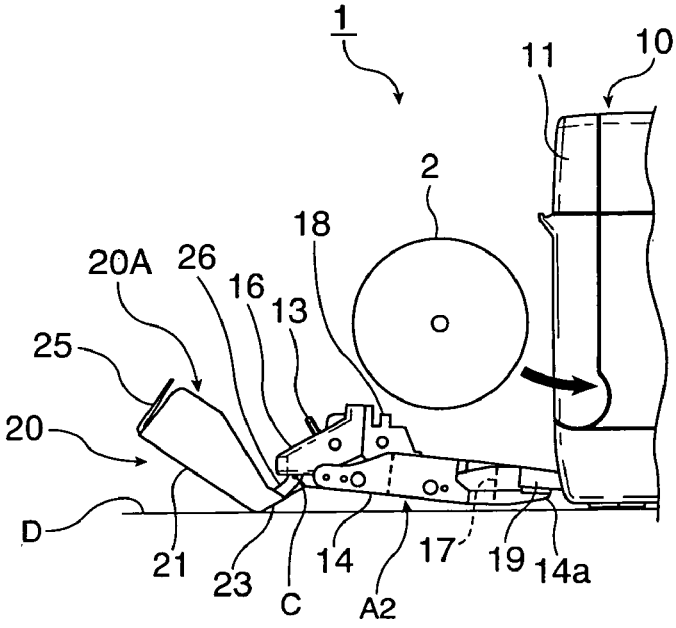
FIG. 2B is a section view when the roll paper cover is open.

The bottom end 14*a* (see FIGS. 2A and 2B) of the roll paper cover 14 is supported by the printer body 10, and the roll paper cover 14 can pivot on a horizontal pivot axis. FIG. 2A and FIG. 2B describe the operations of the roll paper cover 14.

As shown in FIG. 2A, the roll paper cover 14 is in an upright closed position A1 when the opening for replacing the roll paper 2 is closed. To open the opening for replacing the roll paper 2, the lever 15 is operated to unlock the roll paper cover 14. The top end part of the roll paper cover 14 is then pulled forward and the roll paper cover 14 is tilted forward and pivoted to the open position A2 shown in FIG. 2B. This causes the discharge guide 13 and the platen frame 18 and other parts inside the printer to move forward in unison with the roll paper cover 14, thus opening the area from the roll paper compartment formed inside the printer to the paper exit 12 sufficiently to insert the roll paper 2. The roll paper 2 is stored horizontally between the widthwise sides of the printer inside the roll paper compartment. As a result, the roll paper 2 can be easily loaded and replaced from a convenient position in front of the roll paper printer 1.

The overhanging part 16 forms the top end part of the roll paper cover 14, and moves in conjunction with the platen frame 18 located to the inside of the roll paper cover 14. In this embodiment of the invention, the overhanging part 16 is separate from the bottom side part of the roll paper cover 14, and can pivot on a horizontal axis at the top end part of the roll paper cover 14. A four-part linkage mechanism enables the platen frame 18 to remain substantially level while the platen frame 18 moves diagonally forward and down in conjunction with the opening operation of the roll paper cover 14. The overhanging part 16 also moves diagonally downward in conjunction with the platen frame 18 while remaining level. Note that the overhanging part 16 may be supported by the platen frame 18 to move in conjunction with the roll paper cover 14 instead of being attached to the top end part of the roll paper cover 14.

The roll paper cover 14 is connected to the frame inside the printer body 10 or the outside case 11 by a damper mechanism 19 that is attached to a side of the roll paper cover 14. This damper mechanism 19 may be a damper spring or a pneumatic or hydraulic cylinder. The damper mechanism 19 slows the speed of the roll paper cover 14 when the roll paper cover 14 opens or closes faster than a predetermined speed to the open position A2 or closed position A1. The damper mechanism 19 thus softens the impact and noise of the roll paper cover 14 striking the outside case 11 when the roll paper cover 14 closes, and softens the impact and noise of the stacker 20 striking the mounting surface D to which the roll paper cover 14 descends when the roll paper cover 14 is opened.

Configuration of the Stacker

Figure 3:
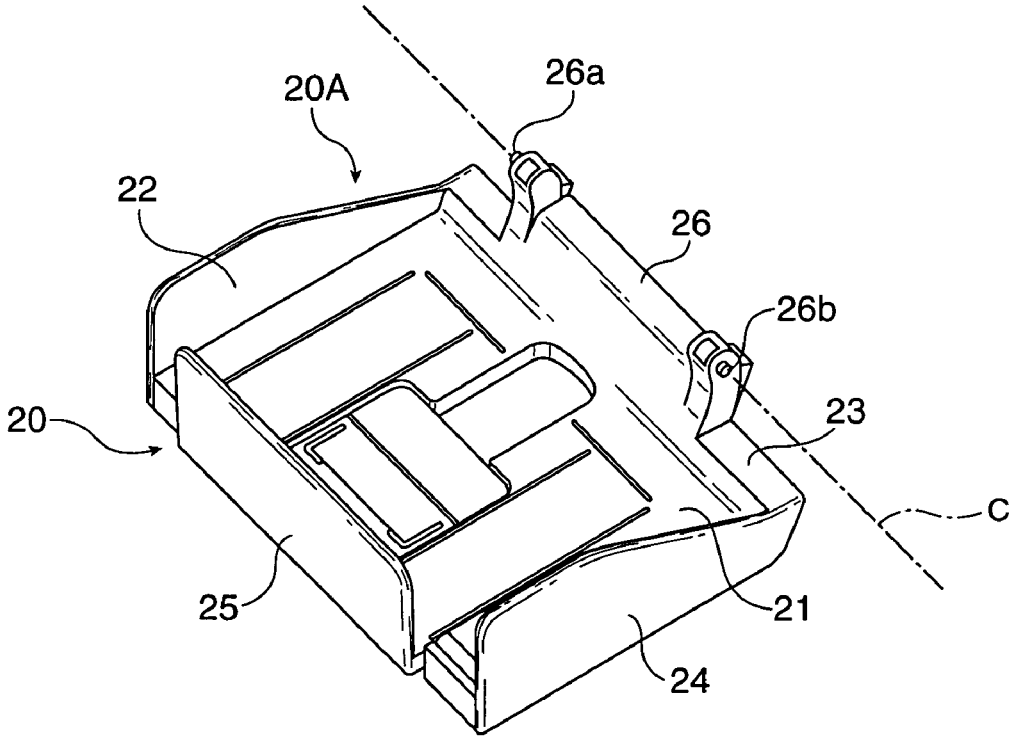
FIG. 3 is an oblique view of the stacker.

FIG. 3 is an oblique view of the stacker 20. The stacker 20 overall has, a rectangular bowl shape projecting from below the overhanging part 16 to the front of the printer body 10 at a downward sloping angle. The stacker 20 has stacker body 20A formed by a rectangular bottom part 21 and three side parts 22, 23, and 24 enclosing three sides of the stacker 20 with a stopper 25 formed at the remaining fourth side. The side part 23 of the stacker body 20A is thicker than the adjacent side parts 22 and 24, and the top end thereof slopes to the outside. The bottom end of an arm part 26 that extends in an inverted T-shape from the side part 23 is connected to the middle part of the side part 23. The left and right side end parts at the top end of the arm part 26 protrude upward, and hinge pins 26*a* and 26*b* protrude to the sides of the arm part 26 from these upward protruding parts. These hinge pins 26*a* and 26*b* are urged to the outside from the side faces of the arm part 26 by an urging member such as a flat spring disposed inside the arm part 26, and can be pushed inside the arm part 26 by pushing in on the ends of the hinge pins 26*a* and 26*b*.

A mounting unit to which the arm part 26 is pivotably attached is disposed at the bottom side of the overhanging part 16. More specifically, hinge pin receivers for pivotably supporting the hinge pins 26*a* and 26*b* disposed to the distal end of the arm part 26 are formed to the bottom side of the overhanging part 16. When the hinge pins 26*a* and 26*b* are fit into these hinge pin receivers, the stacker 20 can pivot on a horizontal axis C, which is the rotational axis of the hinge pins 26*a* and 26*b*. This axis C is parallel to the front surface of the roll paper cover 14.

When the roll paper cover 14 is in the closed position A1, the weight of the stacker 20 causes the arm part 26 to pivot on the hinge pins 26*a* and 26*b* until the back end side of the stacker 20 rotates slightly down and stops at a position against the roll paper cover 14 (see FIG. 2A). More specifically, the side part 23 is pressed against the roll paper cover 14 and stops at a protruding position B1 projecting to the front of the printer from the front of the roll paper cover 14. Because the bottom part 21 slopes downward at this time, paper that is discharged from the paper exit 12 and drops onto the stacker body 20A slides down along the top of the inclined bottom part 21, and the leading end of the paper stops against the stopper 25. The paper thus accumulates at the distal end side of the stacker body 20A.

Operation of the Roll Paper Cover and Stacker

Operation of the roll paper cover 14 and stacker 20 is described next with reference to FIG. 4, FIG. 5A, FIG. 5B, and FIG. 5C.

When the roll paper cover 14 is upright, the stacker 20 is stopped with the side part 23 at the back end thereof resting against the roll paper cover 14 (see FIG. 2A), and the window 17 formed below the overhanging part 16 of the roll paper cover 14 is covered by the stacker 20. As a result, the inside of the printer body 10 cannot be seen through the window 17 at this time. In this embodiment of the invention, however, the stacker 20 can be pivoted up and away from in front of the window 17 without removing the stacker 20. The operator can therefore simply swing the stacker 20 up to see the roll paper 2 stored in the roll paper compartment inside the printer body 10 through the window 17. How much paper remains on the roll paper 2 can therefore be known. This is described in further detail below.

Figure 4:
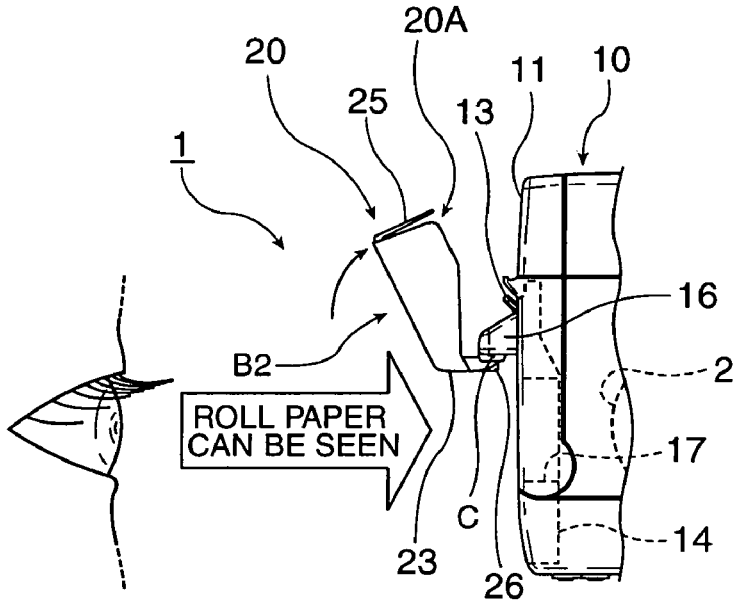
FIG. 4 shows the top end of the movement range of the stacker (in the retracted position).

By lifting the distal end part of the stacker body 20A, that is, the part near the stopper 25, up, the entire stacker 20 pivots up on the axis C. FIG. 4 shows the stacker 20 in the retracted position B2 at the top end of its range of movement. Starting from the protruding position B1 where the bottom part 21 slopes downward, the stacker 20 pivots up through the position where the bottom part 21 protrudes straight out and then to the retracted position B2 where the bottom part 21 slopes up. In the retracted position B2, the sides of the arm part 26 of the stacker 20 touch the bottom of the overhanging part 16 and thus limit further rotation of the stacker 20. Because the stacker body 20A is moved to a position above the arm part 26 when in the retracted position B2, the front of the window 17 is not obstructed. The user can therefore see from the window 17 inside the printer body 10, and can confirm how much roll paper 2 remains through the window 17.

Figure 5A:
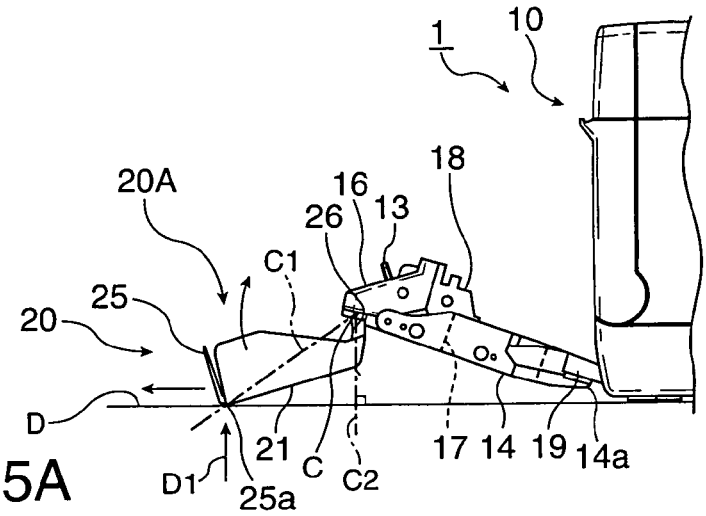
FIG. 5A describes the first operation of the stacker when the roll paper cover moves to the open position side.
Figure 5B:
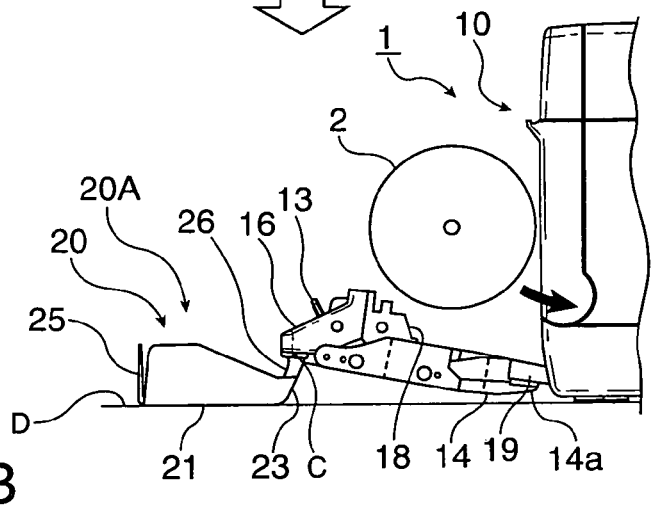
FIG. 5B describes the next operation of the stacker when the roll paper cover moves to the open position side.
Figure 5C:
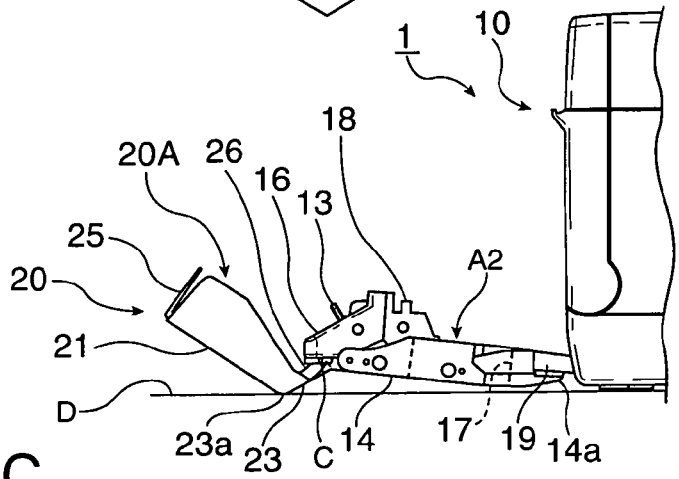
FIG. 5C describes the last operation of the stacker when the roll paper cover moves to the open position side.

FIG. 5A, FIG. 5B, and FIG. 5C describe the operation of the stacker 20 when the roll paper cover 14 moves to the open position A2. When the roll paper cover 14 is pulled open away from the front of the printer body 10, the overhanging part 16 supporting the stacker 20 moves while remaining substantially level as described above. More specifically, the hinge pin receivers disposed at the bottom of the overhanging part 16 keep the same posture as when in the closed position A1. The range of stacker 20 rotation is therefore always the same. Because the side part 23 is pressed against the front of the roll paper cover 14 and is upright as described above, when the roll paper cover 14 starts tilting forward, the stacker 20 first descends while tilting with the roll paper cover 14. When the incline of the roll paper cover 14 then exceeds a predetermined angle (approximately 10 degrees), the arm part 26 pivots on the hinge pins 26*a* and 26*b*, the side part 23 of the stacker 20 separates from the front of the roll paper cover 14, and then descends while hanging freely on its own weight from the bottom of the overhanging part 16.

The stacker 20 descends with the corner part 25*a*, where the stopper 25 and the bottom part 21 meet, facing down. This corner part 25*a* is therefore the first part of the stacker 20 to descend to the same height as the bottom of the printer body 10. The mounting surface D on which the bottom of the printer body 10 is placed in this embodiment of the invention extends to the front and back of the printer body 10 at substantially the same height as the bottom of the printer body 10, and the corner part 25*a* meets this mounting surface D first. As described above, because a damper mechanism 19 is connected to the roll paper cover 14, the shock when the corner part 25*a* contacts the mounting surface D can be sufficiently damped. Problems such as the stacker 20 disconnecting from the roll paper cover 14 and damage to the roll paper cover 14 or stacker 20 can therefore be prevented.

As shown in FIG. 5A, the corner part 25*a* contacts the mounting surface D at a position that is on the opposite side of the axis C on which the stacker 20 pivots as the bottom end 14*a* of the roll paper cover 14. More specifically, the line C1 connecting the corner part 25*a* and the axis C slopes in the opposite direction as the slope of the roll paper cover 14 relative to the vertical line C2 through the axis C. This line C1 has a predetermined angle to the plane extending parallel to the bottom of the printer body 10. That is, the force of repulsion D1 applied from the mounting surface D to the stacker 20 in this position works as a force causing the stacker 20 to pivot up. As a result, the stacker 20 pivots up while the corner part 25*a* slides in front of the printer on the mounting surface D until the bottom part 21 rests on the mounting surface D as shown in FIG. 5B. When the roll paper cover 14 is opened to the position shown in FIG. 5B, the size of the opening from the roll paper cover 14 to the paper exit 12 is greater than the smallest size needed to replace the roll paper 2. As a result, the roll paper 2 can be loaded or replaced from the front of the roll paper printer 1.

The roll paper cover 14 opens further down from the position shown in FIG. 5B, and stops at the open position A2 shown in FIG. 5C. The corner part 23*a* at the bottom end of the side part 23 slides in front of the printer on the mounting surface D at this time while the stacker 20 pivots up. Because the stacker 20 is not pivoted to the retracted position B2 shown in FIG. 4 when the stacker 20 is in the open position A2, the stacker 20 can be pivoted further up from the position shown in FIG. 5C, for example. To close the roll paper cover 14, the user can insert a hand below the roll paper cover 14 and simply lift up on the roll paper cover 14.

Figure 2C:
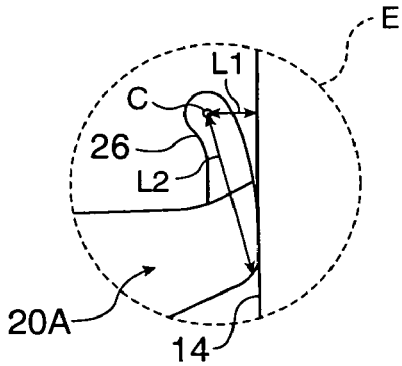
FIG. 2C is an enlarged view of the area near axis C in FIG. 2A.

When positioned as shown in FIG. 5C the stacker body 20A is above the top end of the roll paper cover 14. As shown in FIG. 2C, the length L2 of the arm part 26 is greater than the distance L1 from the axis C to the top end of the roll paper cover 14. Therefore, if the roll paper cover 14 is opened, the stacker 20 separates sufficiently from the roll paper cover 14. The stacker 20 can therefore continue to rotate smoothly after contacting the mounting surface D. As a result, when the roll paper cover 14 is tilted toward the open position A2, problems such as the corner part 25*a* of the stacker 20 not being able to separate sufficiently from the roll paper cover 14, a part of the stacker 20 near the stopper 25 contacting the mounting surface D of the printer and preventing the stacker 20 from pivoting further, or the stacker 20 pivoting in the opposite direction from which it should, can be prevented. The roll paper cover 14 therefore does not interfere with the stacker body 20A, and the stacker body 20A does not become trapped between the roll paper cover 14 and the mounting surface D.

Because the stacker 20 is attached to a forward-opening roll paper cover 14 freely pivotably on a horizontal shaft in this embodiment of the invention, the stacker 20 can be moved away from in front of the window 17 in the roll paper cover 14 by simply lifting the stacker 20 up. It is therefore not necessary to remove the stacker 20 in order to confirm how much paper is left.

Furthermore, when the roll paper cover 14 is opened, the stacker 20 is made to pivot toward the distal end side of the roll paper cover 14, thereby removing the stacker 20 from between the roll paper cover 14 and the mounting surface D. The roll paper cover 14 can therefore be easily pivoted to a position where the roll paper 2 can be replaced without removing the stacker 20. It is therefore not necessary to remove the stacker 20 when opening and closing the roll paper cover 14 in order to replace or load the roll paper 2.

The stacker 20 in this embodiment of the invention has an arm part 26 that extends curving upward from the back end of a rectangular container-shaped stacker body 20A, and the top end part of the arm part 26 is attached to a part on the bottom surface of the overhanging part 16 extended to the front from the front of the roll paper cover 14. The overhanging part 16 remains substantially level while moving in conjunction with the opening and closing action of the roll paper cover 14. The stacker 20 is thus held by its own weight in the protruding position B1 projecting in front of the printer when in the closed position A1, and can therefore receive paper dropped from the distal end of the overhanging part 16.

When the roll paper cover 14 pivots toward the open position A2, the stacker 20 descends of its own weight with the corner part 25*a* leading down so that the corner 25*a* meets the mounting surface D of the printer body 10 before any other part. Because the line C1 connecting the corner part 25*a* and the axis C is inclined with the bottom end pointing forward from the printer at this time, the force of repulsion D1 from the mounting surface D causes the corner part 25*a* to slide in front of the printer as the stacker 20 pivots up (see FIG. 5B). More specifically, when the roll paper cover 14 tilts forward, the stacker 20 automatically meets the mounting surface D and pivots up and retracts toward the top end side of the roll paper cover 14 without applying any external force causing it to pivot up. It is therefore not necessary to manually lift the stacker 20 up when opening the roll paper cover 14.

Because a damper mechanism 19 is disposed between the roll paper cover 14 and the printer body 10 in this embodiment of the invention, the speed at which the roll paper cover 14 opens and closes can be adjusted. Therefore, the force of impact and noise when the roll paper cover 14 contacts the outside case 11 can therefore be buffered. The force of impact and noise when the stacker 20 contacts the mounting surface D of the roll paper cover 14 (see FIG. 5A) can also be buffered when the roll paper cover 14 opens. Damage to the stacker 20 and roll paper cover 14 can also be prevented.

The overhanging part 16 to which the stacker 20 is pivotally attached is held level while moving in conjunction with the platen frame 18 in the embodiment described above, but the part whereby the stacker 20 is attached to the roll paper cover 14 is not so limited. For example, the hinge pin receivers may be formed directly on the front surface of the roll paper cover 14 below the discharge guide 13, and these hinge pin receivers may tilt to the front of the printer in unison with the roll paper cover 14. In this configuration the length of the arm part 26 is greater than the distance between the pivot axis of the stacker and the top end of the discharge guide 13, which is the top end of the roll paper cover 14. When thus configured the stacker body 20A will move above the top end of the roll paper cover 14 when the stacker 20 pivots to the top, and the stacker body 20A will not become trapped between the roll paper cover 14 and the mounting surface. The range of movement of the roll paper cover 14 can therefore be increased.

At least one embodiment of the invention being thus described, it should be understood that it may be varied in many ways. Such variations are not to be regarded as a departure from the spirit and scope of the invention, and all such modifications are intended to be within the scope of the following claims.

What is claimed is:

1. A printer comprising:

a window for viewing a supply of paper in said printer;

a cover; and a stacker that is attached to the cover, the stacker being supported pivotably about a pivot axis on the cover between a protruding position where the stacker receives paper discharged from the printer, and a retracted position rotated a predetermined angle from the protruding position, wherein when said stacker is in said retracted position, said window is not obstructed by said stacker.

2. The printer described in claim 1, wherein: the cover is supported at a bottom part of the printer and can pivot between an upright closed position and an open position where the cover is tilted a predetermined angle; and when the stacker descends in conjunction with the cover pivoting toward the open position, a line from the pivot axis to a leading end of the stacker in a descending direction of the stacker forms a predetermined angle with an extension plane extending parallel to a bottom surface bottom surface of the printer when the leading end reaches a height substantially equal to the extension plane.

3. The printer described in claim 1, wherein:

the cover is supported at a bottom part of the printer and can pivot between an upright closed position and an open position where the cover is tilted a predetermined angle; and when the stacker descends in conjunction with the cover pivoting toward the open position, a line from the pivot axis to a leading end of the stacker slopes in an opposite direction as a slope of a line extending from the pivot axis of the stacker to a pivot axis of the cover relative to a perpendicular passing through the pivot axis of the stacker.

4. The printer described in claim 1, wherein:

the printer has a paper exit; the cover has a discharge guide for guiding printing paper discharged from the paper exit; the discharge guide projects to the outside from the cover; and the stacker is supported pivotably at a bottom end part of the discharge guide.

5. The printer described in claim 1, wherein:

the cover is attached to a front of the printer, and opens and closes an opening communicating with the printing paper storage compartment in the printer.

6. The printer described in claim 1, wherein:

the cover is attached to a front of the printer, and opens and closes an opening communicating with the printing paper storage compartment in the printer.

7. The printer described in claim 6, wherein:

the cover is supported at a bottom part of the printer and can pivot between an upright closed position and an open position where the cover is tilted a predetermined angle; and when the cover is open, the opening is large enough to enable storing a roll of printing paper wound into a roll into the storage compartment.

8. A printer comprising:

a cover; and a stacker that is attached to the cover, the stacker being supported pivotably about a pivot axis on the cover between a protruding position where the stacker receives paper discharged from the printer, and a retracted position rotated a predetermined angle from the protruding position, wherein the stacker has an arm part supported pivotably on the cover; and when the cover pivots toward the closed position, the arm part pivots toward the cover, and the stacker moves to the protruding position, and wherein:

the cover is supported at a bottom part of the printer and can pivot between an upright closed position and an open position where the cover is tilted a predetermined angle; and when the stacker descends in conjunction with the cover pivoting toward the open position, a line from the pivot axis to a leading end of the stacker in a descending direction of the stacker forms a predetermined angle with an extension plane extending parallel to a bottom surface bottom surface of the printer when the leading end reaches a height substantially equal to the extension plane.

9. The printer described in claim 8, wherein:

a length from the pivot axis of the stacker to an end of the arm part is greater than a distance from the pivot axis to a front surface of the cover.

10. A printer comprising:

a cover; and a stacker that is attached to the cover, the stacker being supported pivotably about a pivot axis on the cover between a protruding position where the stacker receives paper discharged from the printer, and a retracted position rotated a predetermined angle from the protruding position, wherein:

the cover has a damper mechanism that adjusts the speed of the cover when the cover pivots to the open position side.

11. A printer comprising:

a cover; and a stacker that is attached to the cover, the stacker being supported pivotably about a pivot axis on the cover between a protruding position where the stacker receives paper discharged from the printer, and a retracted position rotated a predetermined angle from the protruding position: and a window formed at a position in the cover that is covered by the stacker when the cover is in the closed position, wherein:

the cover is supported at a bottom part of the printer and can pivot between an upright closed position and an open position where the cover is tilted a predetermined angle; and when the stacker descends in conjunction with the cover pivoting toward the open position, a line from the pivot axis to a leading end of the stacker in a descending direction of the stacker forms a predetermined angle with an extension plane extending parallel to a bottom surface bottom surface of the printer when the leading end reaches a height substantially equal to the extension plane.

12. A printer comprising:

a cover; and a stacker that is attached to the cover, the stacker being supported pivotably about a pivot axis on the cover between a protruding position where the stacker receives paper discharged from the printer, and a retracted position rotated a predetermined angle from the protruding position; and an overhanging part, which projects in front of the printer from a front of the cover, wherein one end of the stacker is pivotably attached to a bottom side of the overhanging part, and the overhanging part remains substantially level while moving in conjunction with an opening and closing of the roll paper cover.

* * * * *